United States Patent [19]

Lebedev

[11] Patent Number: 4,690,460

[45] Date of Patent: Sep. 1, 1987

[54] POWER UNIT

[75] Inventor: Jury A. Lebedev, Gorno-Altaisk, U.S.S.R.

[73] Assignee: Gorno-Altaisky Gosudarstvenny Pedagogichesky Institut, Gorno-Altaisk, U.S.S.R.

[21] Appl. No.: 791,455

[22] Filed: Oct. 25, 1985

[51] Int. Cl.[4] ..... E21C 37/06

[52] U.S. Cl. ..... 299/21; 299/23

[58] Field of Search ..... 299/20–23; 29/113 R; 269/48.1; 279/2 A; 72/393

[56] References Cited

U.S. PATENT DOCUMENTS 2,004,787 6/1935 Gillette ..... 269/48.1

FOREIGN PATENT DOCUMENTS 111689 10/1940 Australia ..... 299/21

1033819 8/1983 U.S.S.R. .

*Primary Examiner*—James A. Leppink

*Assistant Examiner*—Michael A. Goodwin

*Attorney, Agent, or Firm*—Lilling & Greenspan

[57] ABSTRACT

Disclosure is made of a power unit wherein a housing is made split along its longitudinal axis. A tubular elastic vessel is internally coaxially accommodated in the housing. Disposed between the expandable portions of the housing are expanding inserts trapezoidal in section, bearing by their larger bases against the tubular elastic vessel and by the sides, against the inner walls of the housing portions. For delivery of a working medium into the space of the elastic vessel provision is made for two pipe unions, each of which is installed for longitudinal movement in a holder having a flange disposed in a circular recess made on the inner surface of the housing. An electric element surrounding the elastic vessel is installed in the same circular recess. Each of the elastic vessel ends is disposed between the pipe union and the holder.

4 Claims, 2 Drawing Figures

POWER UNIT

BACKGROUND OF THE INVENTION

1. Field of the Invention

The present invention relates to the mining engineering and, more specifically, to a power unit for destruction of rocks.

The present invention may be used for breaking off large rock monoliths along the line of blastholes followed by disintegration of monoliths into blocks, for explosion-free driving of rock workings, for destruction of foundations of old buidlings and other strong footings. When the power unit is used in boreholes, it may be employed for weakening a difficult-to-collapse roof in mining of the stratified deposits, for positive degassing of coal seams, for fracturing of oil reservoirs and gas-bearing strata, for studying the stressed and deformed state of a rock mass under natural conditions.

The present invention may be used in the metal-working industry as a powerful small-size drive for actuating means of presses, jacks, guillotines and other installations utilizing considerable directed forces.

2. Description of the Prior Art

Known in the prior art is a power unit (cf. USSR Inventor's Certificate No. 420,779, cl. E 21c 39/00, 1974), comprising a housing internally accommodating along the longitudinal axis and throughout the entire length thereof a tubular elastic vessel with sealing means disposed at the ends thereof. The housing of the given power unit comprises two portions one of which is stationary relative to the axis of the power unit, while the other one is an extendable metal plunger. When pressure in the hydraulic system is raised the inner space of the elastic vessel is filled with a working meduim and the vessel is expanded. As the volume occupied by the elastic vessel is restricted by the housing portions, the plunger extends and acts upon an object.

The power unit develops the force in a present direction proportionally to the area of the plunger surface in contact with the elastic vessel. Thus the efficiency of the power unit of the above-mentioned design is low.

We understand the efficiency as a ratio between the force developed by the power unit in a preset direction and the force developed by the elastic vessel. The transverse component of the working medium pressure built up by the elastic vessel, the vector of which is perpendicular to the vector of the force developed by the power unit in the preset direction is not utilized for developing the force in the preset direction. The transverse component causes deformation of the stationary portion of the housing bringing about therein plastic strains which reduce the reliable operation of the power unit. When pressure of the working medium in the elastic vessel is raised, it increases the value of the transverse component. Increase of the transverse component causes formation of clearances between the plunger and the stationary portion of the housing in which the material of the elastic vessel "flows". This condition leads to rupture, i.e. to depressurization of the elastic vessel. The ways for improving rigidity of the housing lead either to an increase in the metal content or to a substantial complication of the power unit manufacturing methods on the whole.

Attempts of increasing the efficiency of the power unit gave rise to the construction disclosed in USSR Inventor's Certificate No. 1,033,819, cl. E21C 37/06, 1982.

The known power unit comprises a longitudinally split housing internally coaxially accommodating a tubular elastic vessel and two expanding inserts, each of which is disposed on the side of the parting line of the housing. In the plane perpendicular to the housing axis the insert has a trapezoidal section the larger base of which bears against the elastic vessel and the sides bear against the inner wall of the housing. In addition, the power unit incorporates two holders each of which is provided with a pipe union intended for delivery of a working medium into the space of the elastic vessel. Each of the ends of the elastic vessel is disposed between the pipe union and the holder. A perforated tubular core is arranged in the space of the elastic vessel along the longitudinal axis thereof. Each end of the perforated tubular core is made in the form of a pipe union. Each of the holders is essentially a sleeve with the internal thread engaged with the external thread of the pipe union; thus the holders are rigidly connected with each other through the medium of the perforated core. The holders are intended for sealing the ends of the elastic vessel.

When the working medium is delivered under pressure into the inner space of the elastic vessel the housing portions are expanded both by the elastic vessel and the expanding inserts.

The known power unit failed to find wide application in breaking natural rock monoliths, for example, granite, off the rock mass because of a limited force developed by the elastic vessel, for example, about 10 MPa, as the power unit cannot develop the required force in the preset direction, i.e. in the direction perpendicular to the plane of the break. This is explained by that the substantial axial loads arising in the tubular core stretch it. This leads to formation of a clearance between the end of the housing and the end of each of the holders facing the elastic vessel. The material of the elastic vessel "flows" in this clearance and then the vessel ruptures. Besides, the core stretching weakens the sealing of the elastic vessel ends which brings about leaks of the working medium. The core stretching may be reduced at the cost of increasing the core cross-sectional area. However, it leads to a sharp increase in the overall dimensions and metal content of the power unit, or in case of maintaining the original overall dimensions of the power unit it brings about a decrease in the working travel of the housing movable portions and a rise of the unit pressure at the place where the side surface of the inserts come in contact with the inner surface of the housing which is not desirable, as it involves the use of special materials and lubricants.

It should also be noted that the trapezoidal shape of the expanding inserts is not optimum, as in case of a non-uniform bearing of the housing expandable portions against the surface of a blasthole or a borehole, a clearance is formed between the side surface of each insert and the inner surface of the housing in which the material of the elastic vessel will "flow".

SUMMARY OF THE INVENTION

It is an object of the present invention to widen the field of the power unit application at the expense of a substantial increase in the force exerted by said unit in a preset direction by way of raising the pressure of the working medium in the elastic vessel, with retention of the preset overall dimensions and reduction of the power unit metal content.

It is another object of the present invention to improve reliability of the power unit operation by way of transmitting the tensile forces set up in the elastic vessel to the expandable portions of the housing and by compensating for microclearances formed at high pressures.

It is still another object of the present invention to improve the reliability of the sealing of the elastic vessel ends by way of clamping them on the pipe unions with a force proportional to an increase in the pressure of the working medium in the elastic vessel.

To accomplish the foregoing and other objects, the invention consists in that in a power unit comprising a longitudinally split housing internally coaxially accommodating a tubular elastic vessel, two expanding inserts each of which is disposed on the side of the housing parting line and has in the plane perpendicular to the housing axis a trapezoidal section the greater base of which bears against the elastic vessel, while the sides bear against the inner wall of the housing, two holders each of which is provided with a pipe union intended for delivery of a working medium into the space of the elastic vessel, each of the ends of the elastic vessel being disposed between the pipe union and the holder, according to the invention, each of the holders has a flange disposed in a circular recess which is made on the inner surface of the housing and accommodates an elastic element surrounding the tubular elastic vessel, and the pipe unions are installed in the holders for longitudinal movement.

Such an embodiment of the power unit widens the field of its application, for example, in explosionfree breaking of large high-strength natural rock monoliths from the rock mass, for fracturing boreholes in the rock mass with the aim of evaluating the stressed state of the earth's crust, preventing the rock bursts, etc. This is achieved by increasing the maximum directed force developed by the power unit due to the fact that the axial force being essentially a longitudinal component of the working medium pressure in the elastic vessel is taken up by the housing of the power unit. This has become feasible due to arrangement of each of the holder flanges in a circular recess made on the inner wall of each of the split housing portions. Now the housing of the power unit is capable of taking up substantial axial forces, as its cross-sectional area considerably exceeds the cross-sectional area of the power unit tubular core disclosed in USSR Inventor's Certificate No. 1,033,819. This improved the longitudinal rigidity of the power unit which made it possible to discard the tubular core, reduce the metal content and to simplify the power unit manufacturing methods. As in the process of the power unit operation the split portions of the housing take up substantial axial forces, the power unit construction is made prestressed. This excludes plastic deformations in the housing which improves reliability and durability of the power unit. Due to an increase in the longitudinal rigidity of the power unit, reliability of its operation at considerable rise of the working medium pressure in the elastic vessel is improved, as the microclearances between the housing and flanges of the holders appearing at high pressures are decreased. In addition, these microclearances are compensated for by expansion of the elastic elements surrounding the tubular elastic vessel, each of the elastic elements being installed in a circular recess made on the inner surface of the housing. Each of the elastic elements is in contact with the face of the holder, the surface of the circular recess and with the face of the expanding insert. This prevents the material of the elastic vessel from "flowing" in the clearances and thus substantially improves reliability of the power unit operation at high pressures, over 100 MPa, of the working medium in the elastic vessel.

The power unit may advantageously be provided with two bushings each of which is rigidly connected with the holder and has a central cylindrical passage for receiving the pipe union, conjugated with the conical surface whose generatrix has an angle of inclination relative to the longitudinal axis of the bushing corresponding to the angle of inclination of the generatrix of the conical surface of the pipe union head, and the generatrix of the conical surface made in the holder has an angle of inclination relative to the longitudinal axis of the holder corresponding to the angle of inclination of the generatrix of another conical surface of the pipe union head, with the conical surfaces of the bushing and the holder facing each other by the larger bases.

During assembly of the power unit the ends of the elastic vessel are clamped between the appropriate conical surfaces. When the working medium is delivered under pressure through the pipe union into the inner space of the elastic vessel, the ends thereof are additionally self-sealed, as the pipe union is adapted for longitudinal movement within the limits governed by the elasticity of the material of the elastic vessel. It should be noted that the greater the pressure in the inner space of the elastic vessel, the stronger is the clamping of the ends thereof between the conical surface of the pipe union head and the respective conical surface in the inner space of the holder. This makes it possible to avoid depressurization of the elastic vessel space at high (of the order of 100 MPa) pressures and hence to increase the force developed by the power unit. Thus, the reliability of sealing of the elastic vessel ends is improved due to their clamping on the conical surface of the pipe union head with a force proportional to an increase of the working medium pressure in the elastic vessel.

Preferably, each of the elastic elements is made in the form of a cone-shaped ring, is installed in a conical recess provided in the end portion of the holder flange and bears by its base against a washer installed in the circular recess of the housing.

Embodiment of the elastic elements in the form of cone-shaped rings allows the wedge effect to be employed for transferring the forces to the washer which in the process of the power unit operation covers an annual microclearance between the holder flange and the movable parts of the construction. This takes place due to the fact that the cone-shaped rings are capable of radial expansion and bear by their bases against the axially movable washers made, for example, of metal. Expansion of the tubular elastic vessel causes a definite radial expansion of the cone-shaped rings which by their bases force the washers against the faces of the housing split portions and the faces of the expanding inserts, thereby compensating for the annular microclearances formed at high pressures and thus prevent the material of the elastic vessel from "flowing" in said microclearances. This substantially improves reliability of the power unit operation.

The power unit according to the invention has found wide application in different branches of the industry, for example, in mining engineering and construction:

for rock quarrying by way of breaking large monoliths along the line of blastholes off the rock mass followed by disintegration of monoliths into blocks;

for explosion-free driving of mine workings (tunnels, adits, etc.) when application of the blasting operations is not permissible;

for destruction of strong footings and foundations of old buildings;

for cleaning up slopes in construction of roads, water developments and other objects under conditions of mountainous terrain;

for weakening of a difficult-to-collapse roof;

for forced degassing of coal seams and prevention of instantaneous outbursts by way of a positive relief of seams;

for fracturing of strata in oil and gas holes;

for studying deformation and strength properties, and the stressed state of a rock mass of any strength in boreholes at a preset depth.

Taking into account its compactness, power and high reliability, the power unit according to the invention is used in the machine-building and metal-working industries as a universal drive of directed action for:

powerful presses and press tools (providing both unilateral and all-round reduction) with a total force of up 100,000 t and upward;

powerful jacks in those cases when there is no need for a substantial working travel;

guillotines used for cutting sheet steel, wire ropes, chains and other materials.

The power unit according to the invention shows promise for use in actuating means of industrial robots.

BRIEF DESCRIPTION OF DRAWINGS

Additional objects and advantages of the invention will appear from the following description in which the preferred embodiment is set forth in detail in conjunction with the accompanying drawings, wherein.

Figure 1:
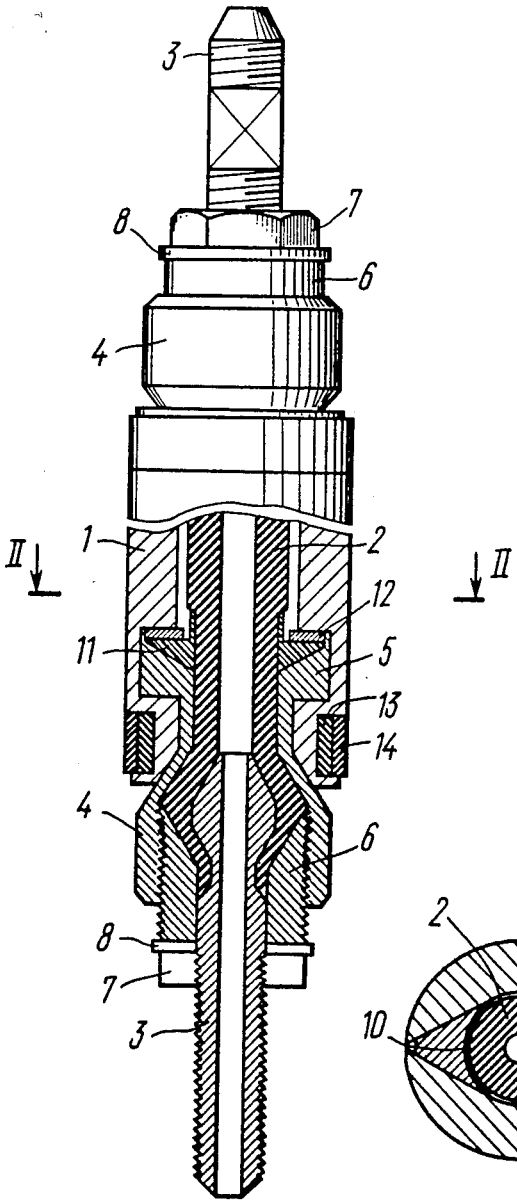
FIG. 1 schematically illustrates a power unit according to the invention, in a partially cut-away view.
Figure 2:
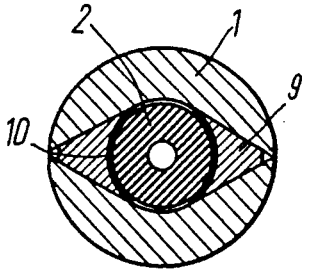
FIG. 2 is a section of FIG. 1 along line II—II, revolved 90°.

A power unit according to the invention designed, for example, for rock quarrying by way of breaking large monoliths along the line of blastholes off the rock mass followed by disintegration of monoliths into blocks, comprises a longitudinally split housing 1 (FIG. 1) coaxially accommodating a tubular elastic vessel 2. Ends of the elastic vessel are put on pipe unions 3. Each of the ends of the elastic vessel 2 is secured between a holder 4 provided with a flange 5 and a bushing 6. This bushing has a cylindrical passage for receiving the pipe union 3, conjugated with a conical surface whose generatrix has an angle of inclination relative to the longitudinal axis of the bushing 6 corresponding to the angle of inclination of the generatrix of the conical surface of the head of the pipe union 3, and the generatrix of the conical surface made in the holder 4 has an angle of inclination relative to the longitudinal axis of the holder 4 corresponding to the angle of inclination of the generatrix of another conical surface of the head of the pipe union 3, with the conical surfaces of the bushing 6 and the holder 4 facing each other by the larger bases. The ends of the tubular elastic vessel 2 are clamped between the conical surfaces of the head of the pipe union 3 and the bushing 6 by means of a nut 7 and a washer 8. Disposed on the side of the parting line of the housing 1 are expanding inserts 9 (FIG. 2), each of which is in the plane perpendicular to the housing axis has a trapezoidal section. Inserts 9 bear against the tubular elastic vessel 2 through liners 10 made of an elastic material. Made on the end surfaces of the flanges 5 (FIG. 1) are conical recesses which accommodate elastic elements made in the form of cone-shaped rings 11 bearing by their bases against washers 12. Elastic rings 13 surrounded by rigid limiting rings 14 are arranged in the circular grooves provided on the outer surface of the housing 1.

The power unit operates in the following way.

When the working medium is delivered through the pipe union 3 into the inner space of the tubular elastic vessel 2, the latter expands; in this case, the force is transmitted to the split portions of the housing 1 both by the tubular elastic vessel 2 and the expanding inserts 9. Under the action of the working medium pressure in the inner space of the elastic vessel 2, the pipe union 3 moves in the longitudinal direction within the limits governed by the elasticity of the material of the elastic vessel, thereby ensuring the self-sealing of the elastic vessel ends. It should be noted that the greater the pressure of the working medium in the space of the elastic vessel, the stronger is the clamping of the ends thereof between the conical surface of the head of the pipe union 3 and the respective inner conical surface of the holder. This makes it possible to avoid depressurization of the elastic vessel 2 at high pressures of about 100 MPa. The pressure of the working medium is transmitted through the tubular elastic vessel 2 to the cone-shaped rings 11 and causes an elastic expansion of the latter in the radial direction; as a result, the cone-shaped rings 11 force the washers 12 against the faces of the expanding inserts 9 and against the side surface of the circular recesses on the inner surface of the housing 1, in which the holders 4 are rigidly fixed against longitudinal displacement. This compensates for the annular microclearances formed at high pressures, thereby preventing the material of the elastic vessel 2 from "flowing" in the microclearances. When the working pressure is reduced to zero, all the movable elements of the power unit return to the original position under the action of the elastic rings 13 which thrust against the rigid limiting rings 14.

The use of the given power unit makes it possible to substantially step up the labour productivity in quarrying and processing of the building stone, improve the safety and to simplify the technology of some underground mining processes. The use of the power unit in the machine-building and metal-working industries as a powerful drive for actuating means of presses and jacks makes it possible to simplify the construction and to reduce the overall dimensions thereof.

The economic efficiency of the invention has been considered on a specific embodiment thereof intended for use in one of the application fields.

A power unit manufactured according to the present invention with a length of 40 cm and outside diameter of 42 mm develops a force of 300 t at a pressure of the working medium in the elastic vessel equal to 100 MPa which allows it to be used as a working means for breaking off the rock monoliths along the line of blastholes.

What is claimed is:

1. A power unit, comprising:

a longitudinally split housing defining a parting line;

an inner wall of said housing;

a tubular elastic vessel coaxially accommodated in said housing;

an inner space of said tubular elastic vessel;

an outer wall of said tubular elastic vessel;

two expanding inserts, each of said inserts being disposed proximate to said parting line of said housing and being trapezoidal in section, the larger base of which bears against said outer wall of said elastic vessel, while the sides bear against said inner wall of said housing;

two pipe unions intended for delivery of a working medium into said space of said tubular elastic vessel;

two holders with two flanges in each of which is installed one of said two pipe unions which is configurated and mounted for longitudinal movement;

two ends of said tubular elastic vessel each of which is disposed between one of said two pipe unions and one of said two holders;

two annular recesses made on said inner wall of said housing;

a flange of each of said two holders arranged in one of said two annular recesses;

two elastic elements, each of which surrounds said outer wall of said tubular elastic vessel and arranged in one of said two annular recesses.

2. A power unit according to claim 1, comprising:

two bushings, each of two said bushings being rigidly connected with one of said two holders;

a head of each of said two pipe unions formed by two conical surfaces;

a central cylindrical passage with a conical surface at one of its ends for installation of one of said two pipe unions, made in each of said two bushings, a generatrix of the conical surface has an angle of inclination relative to the longitudinal axis of one of said two bushings, corresponding to the angle of inclination of the generatrix of one conical surface of said head of one of said two pipe unions;

a truncated conical surface made in each of two said holders defining a larger base and a smaller base, the larger base substantially longitudinally coinciding with the conical surface made in each of said two bushings;

the generatrix of said conical surface has an angle of inclination relative to the longitudinal axis of one of two said holders corresponding to the angle of inclination of the generatrix of another conical surface of said head of one of said two pipe unions.

3. A power unit according to claim 1, comprising:

a washer installed in each of said two annular recesses;

a conical recess made in the end portion of said flange of each of said two holders and intended for internally accommodating one of said two elastic which is made in the form of a cone-shaped ring bearing by its larger base against said washer.

4. A power unit according to claim 2, comprising:

a washer installed in each of said two annular recesses.

a conical recess made in the end portion of said flange of each of said two holders and intended for internally accommodating one of said two elastic elements which is made in the form of a cone-shaped ring bearing by its larger base against said washer.

* * * * *